US007981226B2

(12) United States Patent
Pourdeyhimi et al.

(10) Patent No.: US 7,981,226 B2
(45) Date of Patent: Jul. 19, 2011

(54) HIGH STRENGTH, DURABLE MICRO AND NANO-FIBER FABRICS PRODUCED BY FIBRILLATING BICOMPONENT ISLANDS IN THE SEA FIBERS

(75) Inventors: Behnam Pourdeyhimi, Cary, NC (US); Nataliya V. Fedorova, Raleigh, NC (US); Stephen R. Sharp, Holly Springs, NC (US)

(73) Assignee: North Carolina State University, Raleigh, NC (US)

( * ) Notice: Subject to any disclaimer, the term of this patent is extended or adjusted under 35 U.S.C. 154(b) by 0 days.

(21) Appl. No.: 11/473,534

(22) Filed: Jun. 23, 2006

(65) Prior Publication Data

US 2006/0292355 A1 Dec. 28, 2006

Related U.S. Application Data

(60) Provisional application No. 60/694,121, filed on Jun. 24, 2005.

(51) Int. Cl.
*D04H 1/46* (2006.01)
*D04H 3/10* (2006.01)

(52) U.S. Cl. ... 156/62.4; 156/148; 156/167; 264/172.13

(58) Field of Classification Search ..... 156/62.2, 156/62.4, 167, 178, 181, 148; 264/112, 115, 264/122, 126, 172.13, 346; 428/373, 397
See application file for complete search history.

(56) References Cited

U.S. PATENT DOCUMENTS 3,418,200 A 12/1968 Tanner
3,562,374 A * 2/1971 Okamoto et al. ..... 264/128
3,629,047 A 12/1971 Davison
3,724,198 A 4/1973 Kim
3,751,777 A 8/1973 Turmel et al.
3,829,324 A 8/1974 Blais et al.
3,855,046 A 12/1974 Hansen et al.
3,914,365 A 10/1975 Kim et al.
4,102,969 A 7/1978 Neveu et al.
4,127,696 A * 11/1978 Okamoto ..... 428/373
4,207,376 A 6/1980 Nagayasu et al.
4,274,251 A 6/1981 Kim et al.
4,381,335 A * 4/1983 Okamoto ..... 428/373
4,519,804 A 5/1985 Kato et al.
4,551,378 A 11/1985 Carey, Jr.
4,612,228 A * 9/1986 Kato et al. ..... 428/151
4,620,852 A * 11/1986 Nishikawa et al. ..... 8/515
4,866,107 A 9/1989 Doxsee et al.
5,009,239 A 4/1991 Cohen et al.

(Continued)

FOREIGN PATENT DOCUMENTS

DE 100 26 281 A1 12/2001

(Continued)

*Primary Examiner* — Michael A Tolin

(74) *Attorney, Agent, or Firm* — Womble Carlyle Sandridge & Rice, PLLC

(57) ABSTRACT

The subject matter disclosed herein relates generally to fabrics composed of micro-denier fibers wherein said fibers are formed as bicomponent fibrillated fiber. The energy is sufficient for fibrillating as well as entangling (bonding) the fibers. These fabrics can be woven or knitted and made from made from bicomponent islands in the sea fibers and filaments or can be nonwovens and formed by either spunbonding or through the use of bicomponent staple fibers formed into a web by any one of several means and bonded similarly to those used for the spunbonded filament webs.

36 Claims, 19 Drawing Sheets

Examples of Bicomponent Fibers Produced in the Spunbonding Processing

Sheath-Core (1 Island-in-Sea), 75/25% Nylon/PE

36 Island-in-Sea, 50/50% Nylon/PE

18 Island-in-Sea, 50/50% Nylon/PE

108 Island-in-Sea, 75/25% Nylon/PE

U.S. PATENT DOCUMENTS

| | | | | |
|---|---|---|---|---|
| 5,045,387 | A | 9/1991 | Schmalz | |
| 5,141,522 | A | 8/1992 | Landi | |
| 5,334,177 | A | 8/1994 | Cohen | |
| 5,336,552 | A | 8/1994 | Strack et al. | |
| 5,403,426 | A | 4/1995 | Johnson et al. | |
| 5,470,640 | A | 11/1995 | Modrak | |
| 5,472,995 | A | 12/1995 | Kaminski et al. | |
| 5,582,904 | A | 12/1996 | Harrington | |
| RE35,621 | E | 10/1997 | Schmalz | |
| 5,721,048 | A | 2/1998 | Schmalz | |
| 5,783,503 | A | 7/1998 | Gillespie et al. | |
| 5,786,065 | A | 7/1998 | Annis et al. | |
| 5,827,443 | A | 10/1998 | Kita et al. | |
| 5,869,010 | A | 2/1999 | Langer | |
| 5,889,080 | A | 3/1999 | Kaminski et al. | |
| 5,899,785 | A | 5/1999 | Groten et al. | |
| 5,916,678 | A | 6/1999 | Jackson et al. | |
| 5,919,837 | A | 7/1999 | Kaminski et al. | |
| 5,948,528 | A | 9/1999 | Helms, Jr. et al. | |
| 5,972,497 | A | 10/1999 | Hirwe et al. | |
| 6,110,991 | A | 8/2000 | Kaminski et al. | |
| 6,335,092 | B1 * | 1/2002 | Takeda et al. | 428/359 |
| 6,448,462 | B2 | 9/2002 | Groitzsch et al. | |
| 6,455,156 | B1 | 9/2002 | Tanaka et al. | |
| 6,506,873 | B1 | 1/2003 | Ryan et al. | |
| 6,632,313 | B2 | 10/2003 | Nickel et al. | |
| 7,291,300 | B2 | 11/2007 | Chhabra et al. | |
| 2002/0006502 | A1 | 1/2002 | Nagaoka et al. | |
| 2003/0118776 | A1 | 6/2003 | Anderson et al. | |
| 2003/0203695 | A1 * | 10/2003 | Polanco et al. | 442/365 |
| 2004/0266300 | A1 | 12/2004 | Isele et al. | |
| 2005/0032450 | A1 | 2/2005 | Haggard et al. | |
| 2005/0070866 | A1 | 3/2005 | Isele et al. | |
| 2006/0014460 | A1 | 1/2006 | Isele et al. | |
| 2006/0057922 | A1 | 3/2006 | Bond et al. | |
| 2006/0084340 | A1 | 4/2006 | Bond et al. | |
| 2007/0227359 | A1 | 10/2007 | Choi | |

FOREIGN PATENT DOCUMENTS

| | | | |
|---|---|---|---|
| EP | 0 696 629 | A1 | 2/1996 |
| EP | 0 696 691 | A1 | 2/1996 |
| GB | 1 311 085 | | 3/1973 |
| GB | 1 323 296 | | 7/1973 |
| JP | 5-106118 | * | 4/1993 |
| JP | 2005171408 | | 6/2005 |
| WO | WO 2005/004769 | A1 | 1/2005 |

* cited by examiner

Typical Bicomponent Segmented Pie Fiber, Solid (Left) and Hollow (Right)

Typical Bicomponent Segmented Ribbon Fiber

Typical Bicomponent Segmented Cross and Tipped Trilobal Fibers
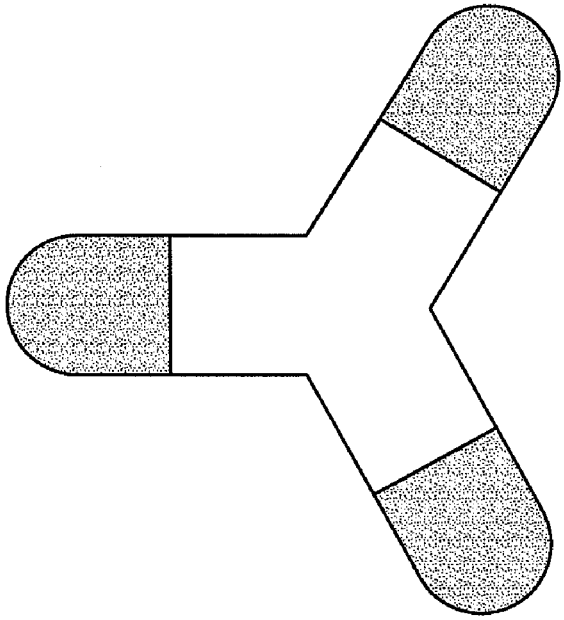
Tipped Tri-lobal
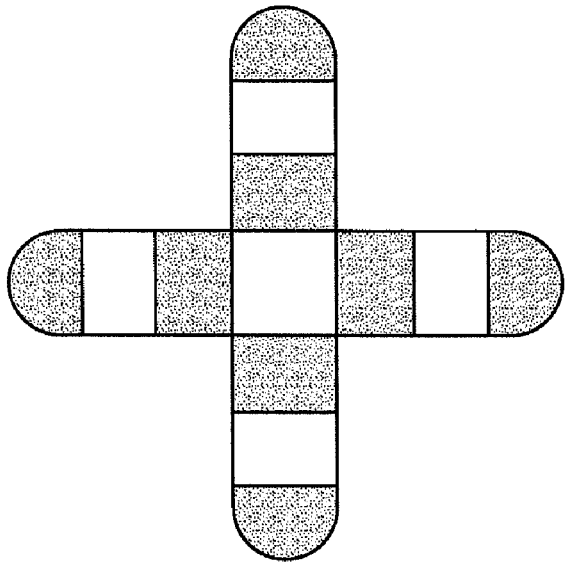
Segmented Cross
FIG. 3

Typical Process for Hydroentangling Using Drum Entangler

Bicomponent Fibers - Islands-in the Sea (Left) and Sheath-Core (Right)

Examples of Bicomponent Fibers Produced in the Spunbonding Processing
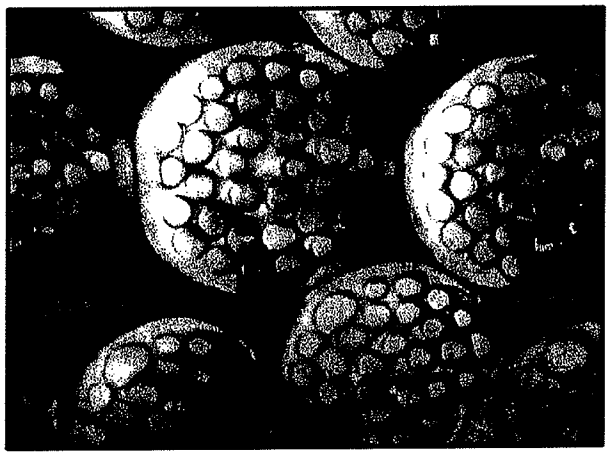
36 Island-in-Sea, 50/50% Nylon/PE
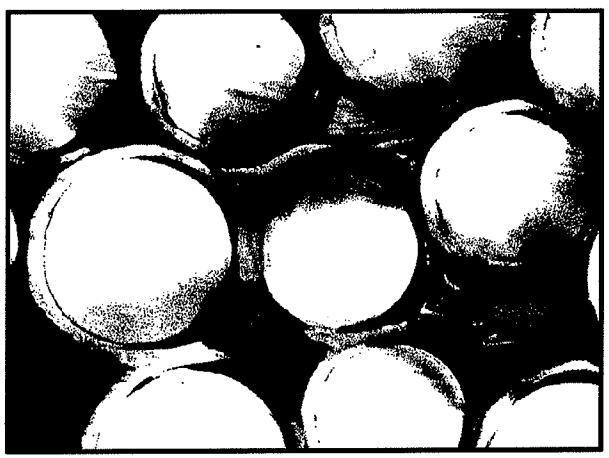
Sheath-Core (1 Island-in-Sea), 75/25% Nylon/PE
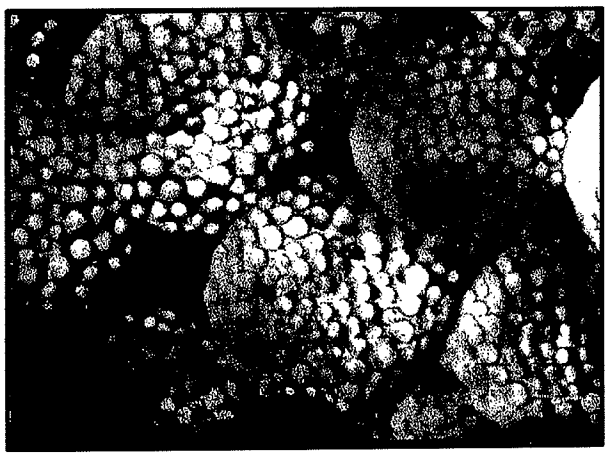
108 Island-in-Sea, 75/25% Nylon/PE
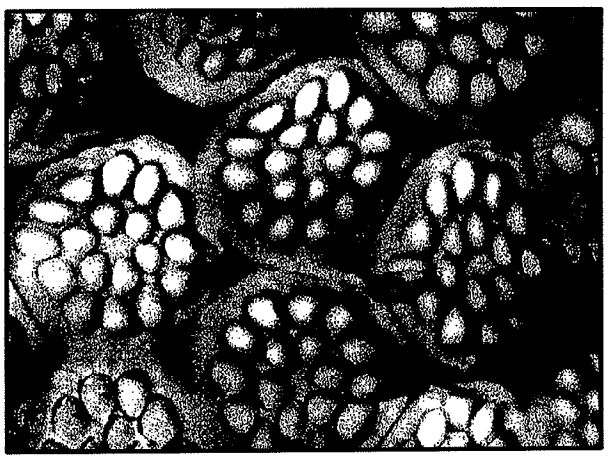
18 Island-in-Sea, 50/50% Nylon/PE
FIG. 7

SEM Micrographs of Surface of an I-S Hydroentangled Spunbonded Fabric with Fibers Partially Separated 108 I/S 75/25 Nylon6/PE SEM Micrographs of Surface of an I-S Hydroentangled (Two Passes) and Dyed Spunbonded Fabric with Fibers Almost Completely Separated SEM Micrographs of Surface of an I-S Hydroentangled Spunbonded Fabric with Fibers Completely Separated 108 I/S 75/25 Nylon/PE, 1 Hydro Pass
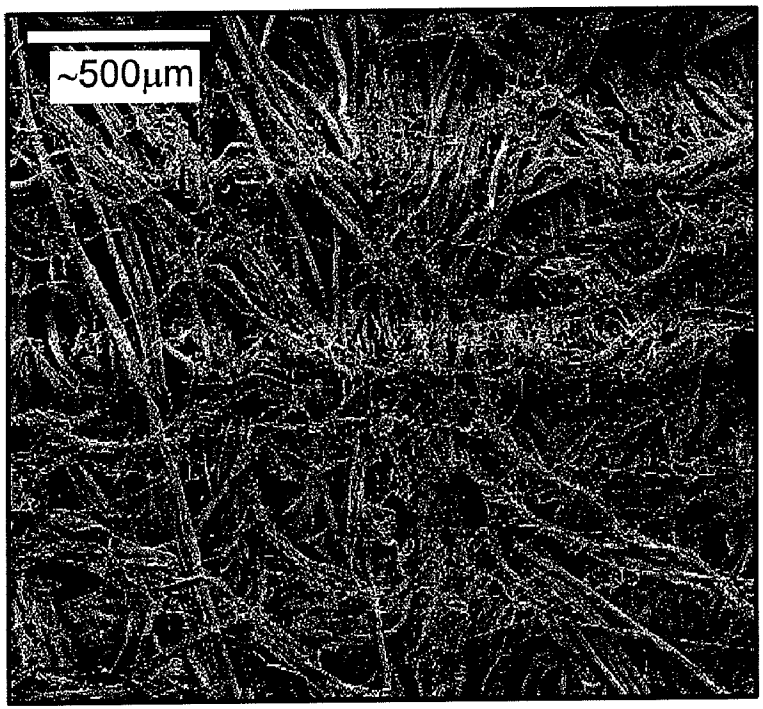
100 - 120 gsm
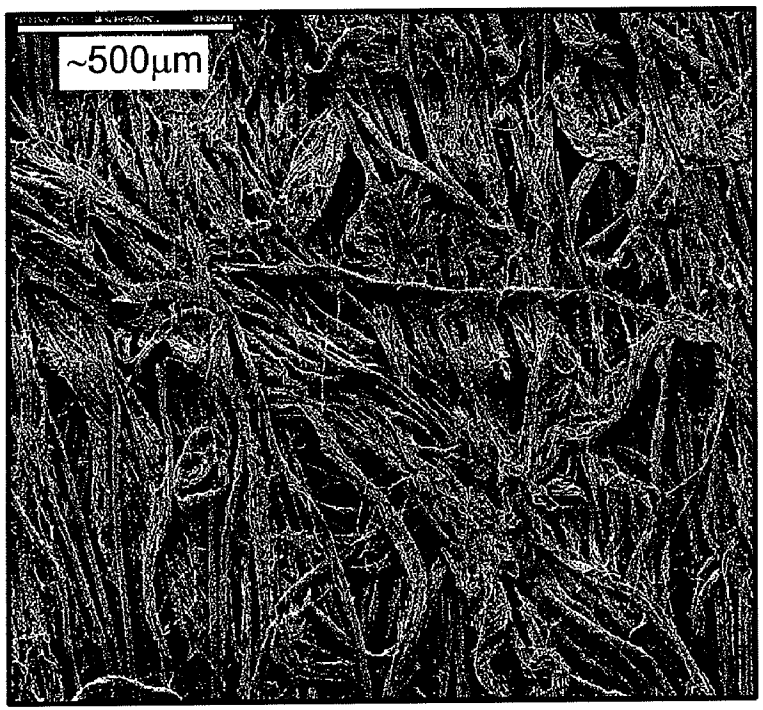
180 - 200 gsm
SEM Micrographs of Surface of an I-S Hydroentangled Spunbonded Fabric
FIG. 11

108 I/S 75/25 Nylon/PE, 1 Hydro Pass
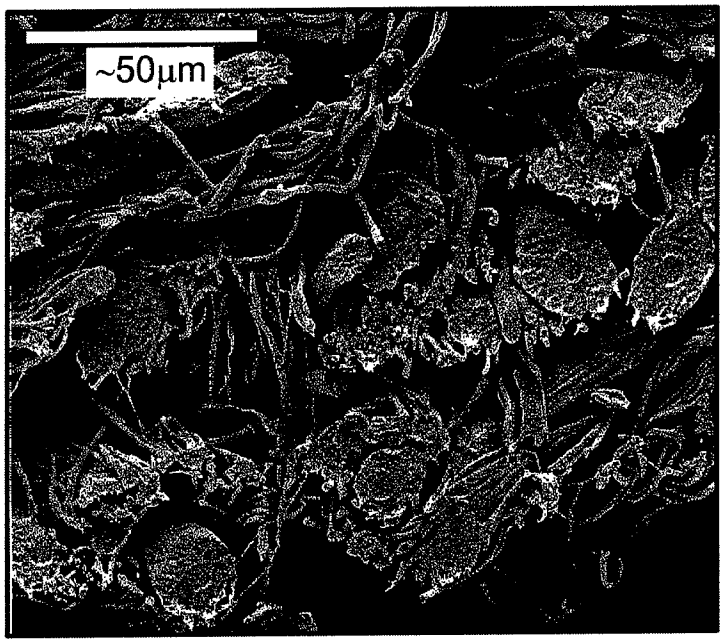
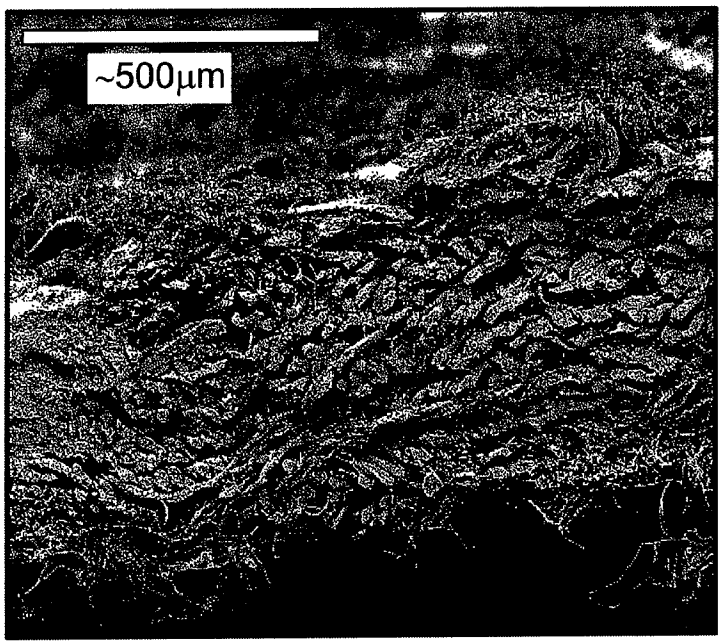
100 - 120 gsm
SEM Micrographs of Cross-section of an I-S Hydroentangled Spunbonded Fabric
FIG. 12

108 I/S 75/25 Nylon/PE
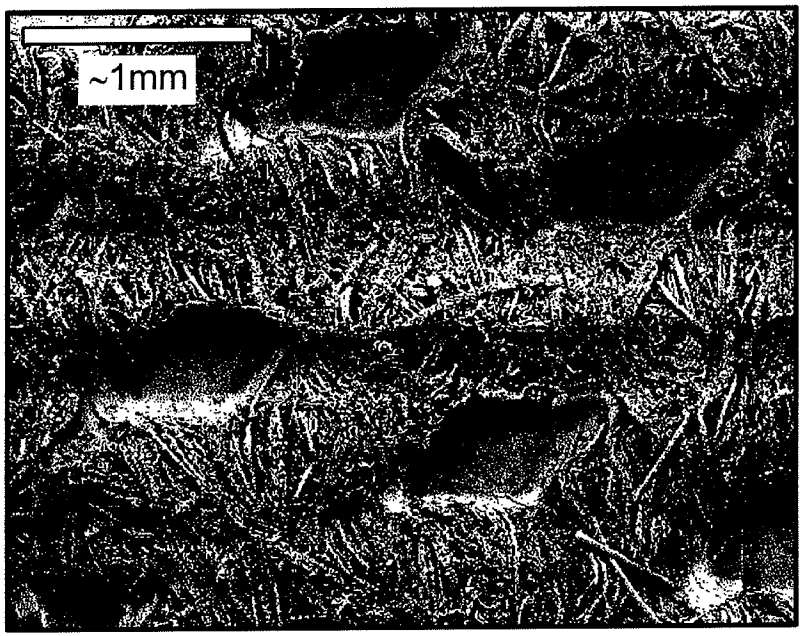
2 Hydro Passes + Point Bonded at 145 °C
180 - 200 gsm
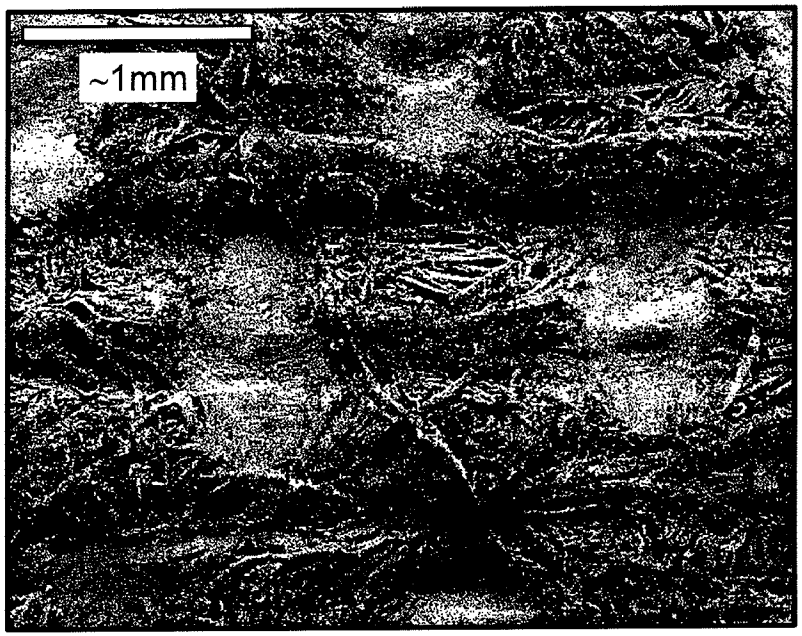
1 Hydro Pass + Point Bonded at 145 °C
100 - 120 gsm
SEM Micrographs of Surface of an I-S Hydroentangled Spunbonded Fabric with Fibers Completely Separated
FIG. 13

108 I/S 75/25 Nylon/PE
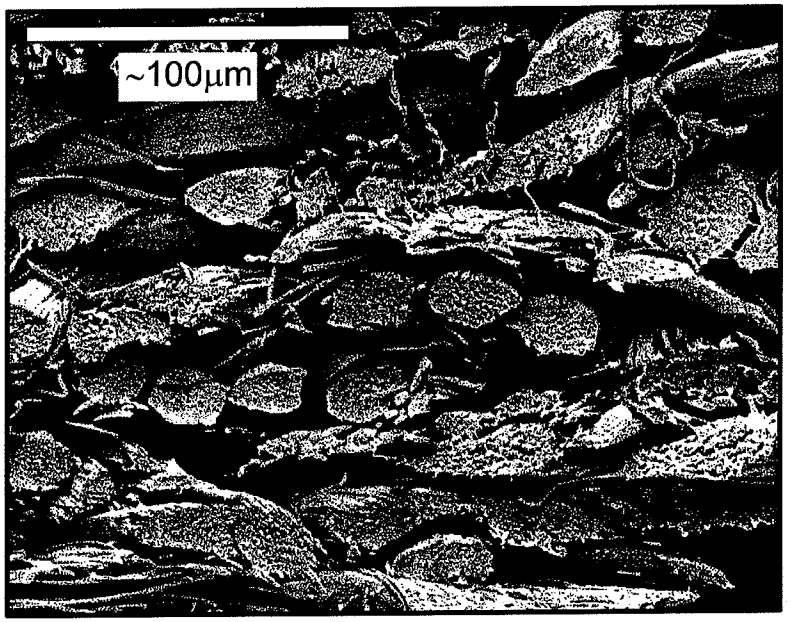
2 Hydro Passes + Point Bonded at 145 °C
180 - 200 gsm
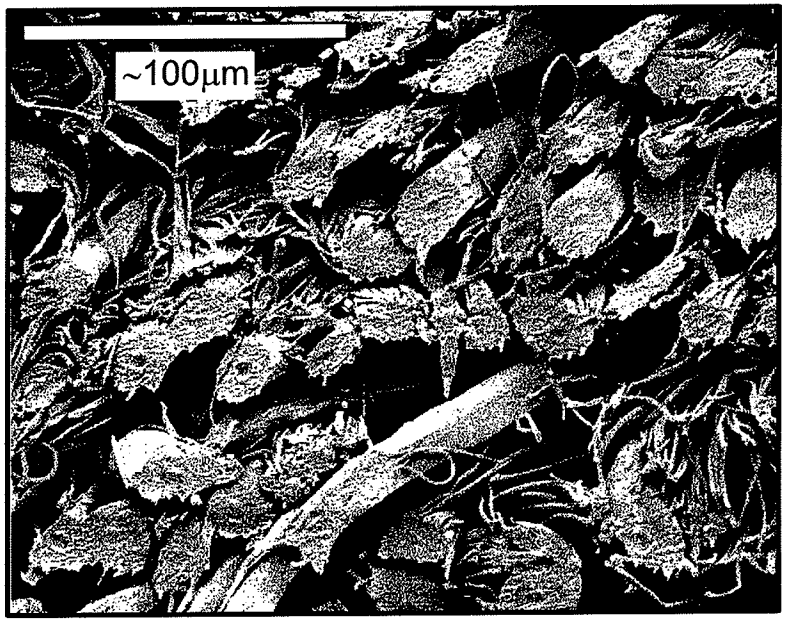
1 Hydro Pass + Point Bonded at 145 °C
100 - 120 gsm
SEM Micrographs of Cross-section of an I-S Spunbonded Fabric Before Fibrillating
FIG. 14

108 I/S 75/25 Nylon/PE
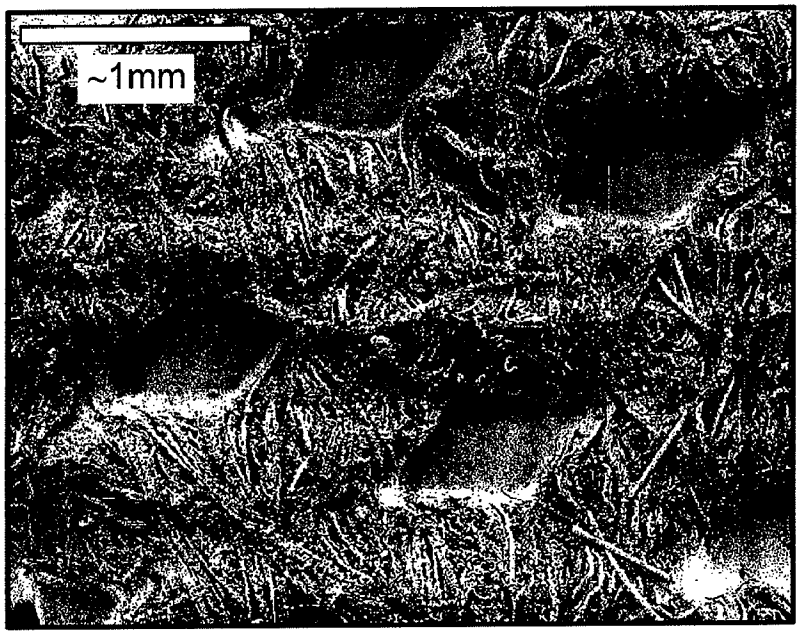
2 Hydro Passes + Point Bonded at 145 °C
180 - 200 gsm
Orange Dye
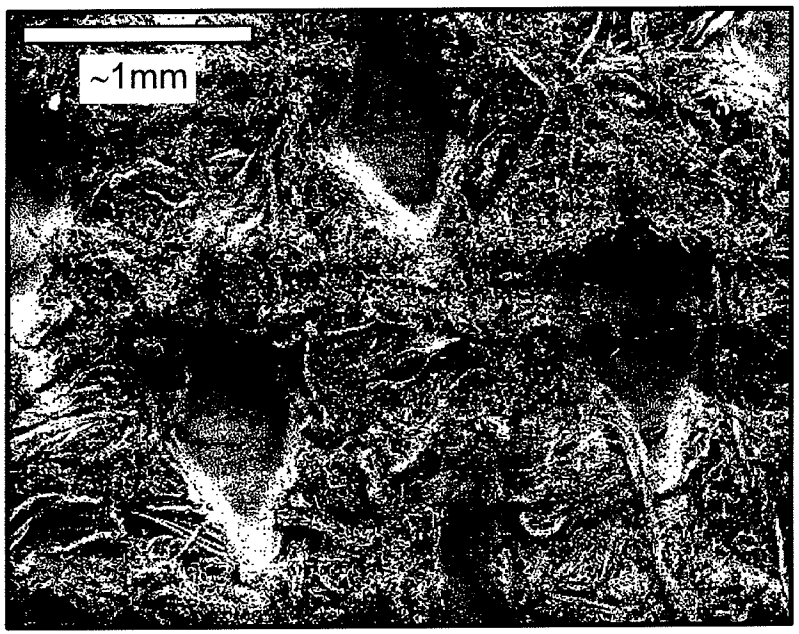
1 Hydro Pass + Point Bonded at 145 °C
180 - 200 gsm
Black Dye
FIG. 15

108 I/S 75/25 Polyester/PE
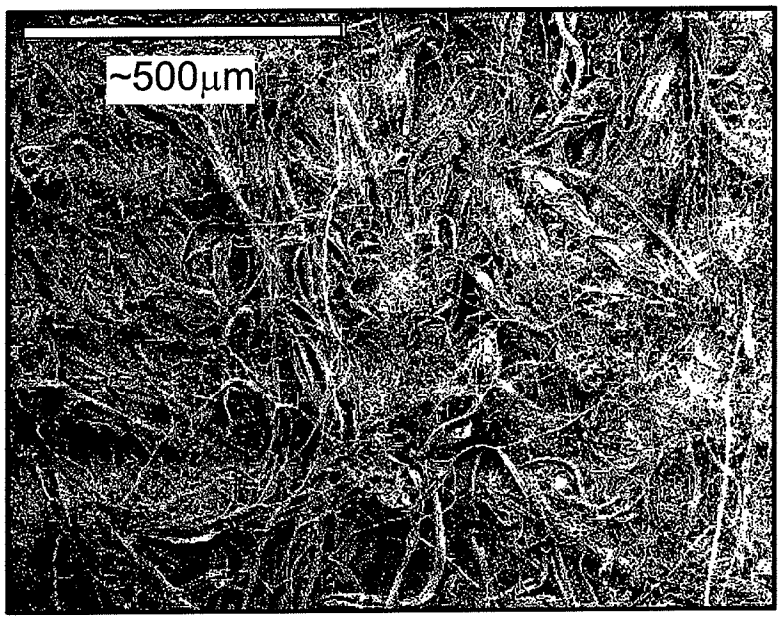
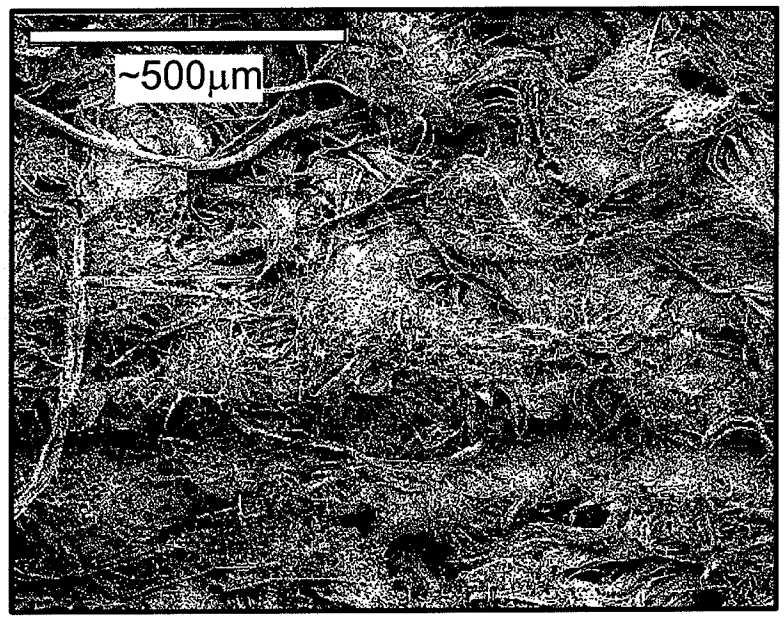
2 Hydro Passes
140 - 150 gsm
FIG. 16

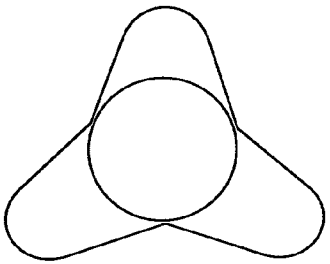

Modified Tipped Tri-lobal
The Core is Wrapped by the Tips. Spinning is Easy.
This can also Done by Trilobal Sheath-core Structure.

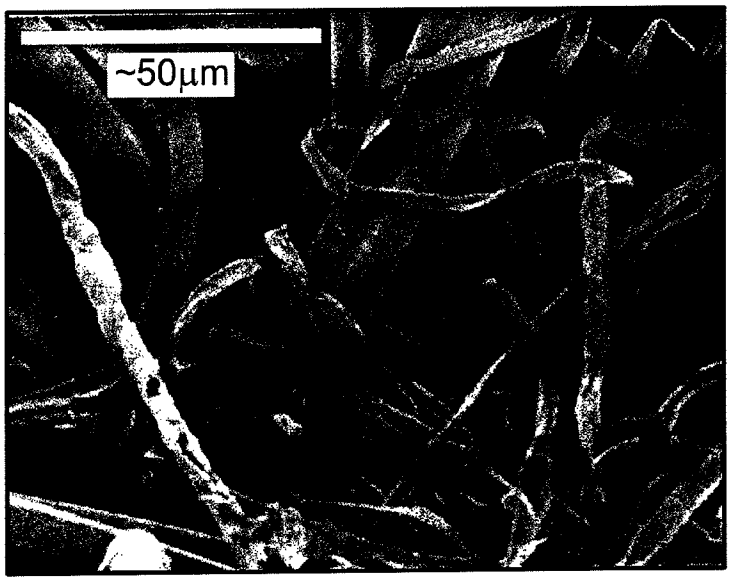

Modified Tipped Tri-lobal. The Core is Wrapped by the Tips.
The Fibers can be Fractured to Produce 4 Separate Fibers. This
SEM Micrograph Shows the Process of Fracturing the Tips or
the Sheath by Hydroentangling

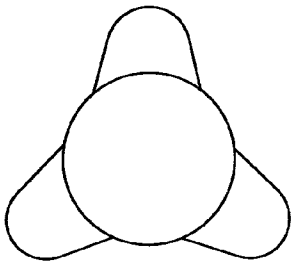

Tipped Tri-lobal
Both the Core and the Tips are Exposed
on Surface. Spinning would be Difficult
for Incompatible Polymers

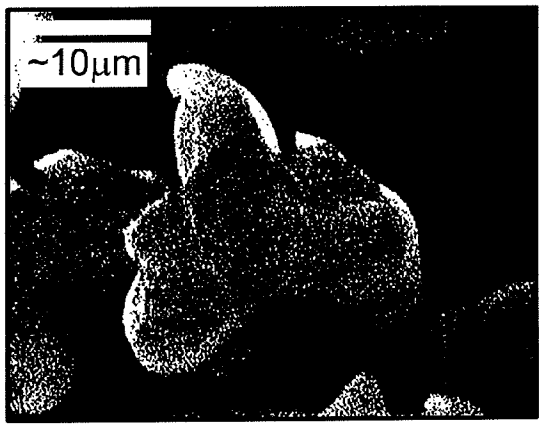

FIG. 17

SEM Micrographs of Trilobal Fabric after Fibrillating

HIGH STRENGTH, DURABLE MICRO AND NANO-FIBER FABRICS PRODUCED BY FIBRILLATING BICOMPONENT ISLANDS IN THE SEA FIBERS

PRIORITY

This utility application claims priority to U.S. Provisional Patent Application Ser. No. 60/694,121 dated Jun. 24, 2005.

TECHNICAL FIELD

The invention relates generally to the manufacture of micro-denier fibers and nonwoven products manufactured from such fibers having high strength. More particularly, the invention relates to producing such fibers from island in the sea configurations wherein the sea component is fibrillated from the island components.

BACKGROUND

Nonwoven Spunbonded fabrics are used in many applications and account for the majority of products produced or used in North America. Almost all such applications require a lightweight disposable fabric. Therefore, most spunbonded fabrics are designed for single use and are designed to have adequate properties for the applications for which they are intended. Spunbonding refers to a process where the fibers (filaments) are extruded, cooled, and drawn and subsequently collected on a moving belt to form a fabric. The web thus collected is not bonded and the filaments must be bonded together thermally, mechanically or chemically to form a fabric. Thermal bonding is by far the most efficient and economical means for forming a fabric. Hydroentangling is not as efficient, but leads to a much more flexible and normally stronger fabric when compared to thermally bonded fabrics.

Micro-denier fibers are fibers which are smaller than 1 denier. Typically, micro-denier fibers are produced utilizing a bicomponent fiber which is split. FIG. 1 illustrates the best know type of splittable fiber commonly referred to as "pie wedge" or "segmented pie." U.S. Pat. No. 5,783,503 illustrates a typical meltspun muticomponent thermoplastic continuous filament which is split absent mechanical treatment. In the configuration described, it is desired to provide a hollow core filament. The hollow core prevents the tips of the wedges of like components from contacting each other at the center of the filament and promotes separation of the filament components.

In these configurations, the components are segments typically made from nylon and polyester. It is common for such a fiber to have 16 segments. The conventional wisdom behind such a fiber has been to form a web of typically 2 to 3 denier per filament fibers by means of carding and/or airlay, and subsequently split and bond the fibers into a fabric in one step by subjecting the web to high pressure water jets. The resultant fabric will be composed of micro-denier fibers and will possess all of the characteristics of a micro-denier fabric with respect to softness, drape, cover, and surface area.

When manufacturing bicomponent fibers for splitting, several characteristics of the fibers are typically required for consideration to ensure that the continuous fiber may be adequately manufactured. These characteristics include the miscibility of the components, differences in melting points, the crystallization properties, viscosity, and the ability to develop a triboelectric charge. The copolymers selected are typically done to ensure that these characteristics between the bicomponent fibers are accommodating such that the muticomponent filaments may be spun. Suitable combinations of polymers include polyester and polypropylene, polyester and polyethylene, nylon and polypropylene, nylon and polyethylene, and nylon and polyester. Since these bicomponent fibers are spun in a segmented cross-section, each component is exposed along the length of the fiber. Consequently, if the components selected do not have properties which are closely analogous, the continuous fiber may suffer defects during manufacturing such as breaking, or crimping. Such defects would render the filament unsuitable for further processing.

U.S. Pat. No. 6,448,462 discloses another multicomponent filament having an orange-like multisegment structure representative of a pie configuration. This patent also discloses a side-by-side configuration. In these configurations, two incompatible polymers such as polyesters and a polyethylene or polyamide are utilized for forming a continuous multicomponent filament. These filaments are melt-spun, stretched and directly laid down to form a nonwoven. The use of this technology in a spunbond process coupled with hydro-splitting is now commercially available by a product marketed under the Evolon® trademark by Freudenberg and is used in many of the same applications described above.

The segmented pie is only one of many possible splittable configurations. In the solid form, it is easier to spin, but in the hollow form, it is easer to split. To ensure splitting, dissimilar polymers are utilized. But even after choosing polymers with low mutual affinity, the fiber's cross section can have an impact on how easily the fiber will split. The cross section that is most readily splittable is a segmented ribbon, such as that shown in FIG. 2. The number of segments has to be odd so that the same polymer is found at both ends so as to "balance" the structure. This fiber is anisotropic and is difficult to process as a staple fiber. As a filament, however, it would work fine. Therefore, in the spunbonding process, this fiber can be attractive. Processing is improved in fibers such as tipped trilobal or segmented cross. See FIG. 3.

Another disadvantage utilizing segmented pie configurations is that the overall fiber shape upon splitting is a wedge shape. This configuration is a direct result of the process to producing the small micro-denier fibers. Consequently, while suitable for their intended purpose, nonetheless, other shapes of fibers may be desired which produce advantageous application results. Such shapes are currently unavailable under standard segmented processes.

Accordingly, when manufacturing micro-denier fibers utilizing the segmented pie format certain limitations are placed upon the selection of the materials utilized and available. While the components must be of sufficiently different material so the adhesion between the components is minimized facilitating separation, they nonetheless also must be sufficiently similar in characteristics in order to enable the fiber to be manufacturing during a spun-bound or melt-blown process. If the materials are sufficiently dissimilar, the fibers will break during processing.

Another method of creating micro-denier fibers utilizes fibers of the island in the sea configuration. U.S. Pat. No. 6,455,156 discloses one such structure. In an island in the sea configuration a primary fiber component, the sea, is utilized to envelope smaller interior fibers, the islands. Such structures provide for ease of manufacturing, but require the removal of the sea in order to reach the islands. This is done by dissolving the sea in a solution which does not impact the islands. Such process is not environmentally friendly as an alkali solution is utilized which requires waste water treatment. Additionally, since it is necessary to extract the island components the method restricts the types of polymers which may be utilized in that they are not affected by the sea removal solution.

Such island in the sea fibers are commercially available today. They are most often used in making synthetic leathers and suedes. In the case of synthetic leathers, a subsequent step introduces coagulated polyurethane into the fabric, and may also include a top coating. Another end-use that has resulted in much interest in such fibers is in technical wipes, where the small fibers lead to a large number of small capillaries resulting in better fluid absorbency and better dust pick-up. For a similar reason, such fibers may be of interest in filtration.

In summary, what has been accomplished so far has limited application because of the limitations posed by the choice of the polymers that would allow ease of spinning and splittability for segmented fibers. The spinning is problematic because both polymers are exposed on the surface and therefore, variations in elongational viscosity, quench behavior and relaxation cause anisotropies that lead to spinning challenges. Further, a major limitation of the current art is that the fibers form wedges and there is no flexibility with respect to fiber cross sections that can be achieved.

An advantage with an island in the sea technology is that if the spinpack is properly designed, the sea can act as a shield and protect the islands so as to reduce spinning challenges. However, with the requirement of removing the sea, limitations upon the availability of suitable polymers for the sea and island components are also restricted. Heretofore, islands in the sea technology is not employed for making micro-denier fibers other than via the removal of the sea component because of the common belief that the energy required to separate the island in the sea is not commercially viable.

Accordingly, there is a need for a manufacturing process which can produce micro-denier fibers dimensions in a manner which is conducive to spin bound processing and which is environmentally sound.

SUMMARY OF THE INVENTION

In accordance with one embodiment of the present subject matter, a method for producing micro-denier fabrics is disclosed wherein bicomponent islands in the sea fiber/filaments are fibrillated wherein the sea island remains integrated with the island fibers forming a high strength nonwoven fabric.

It is therefore, an object of the present subject matter to provide a method for producing high surface area, micro-denier fabrics; other objects will become evident as the description proceeds when taken in connection with the accompanying drawings as best described herein below.

BRIEF DESCRIPTION OF THE DRAWINGS

The methods and systems designed to carry out the invention will hereinafter be described, together with other features thereof.

The invention will be more readily understood from a reading of the following specification and by reference to the accompanying drawings forming a part thereof:

FIG. 3 is schematic of typical segmented cross and tipped trilobal fibers;

FIG. 7 depicts examples of bicomponent fibers produced in the spunbonding processing;

FIG. 11 shows SEM Micrographs of surface of an I-S hydroentangled spunbonded fabric.

FIG. 12 shows SEM Micrographs of cross-section of an I-S hydroentangled spunbonded fabric.

FIG. 13 shows SEM Micrographs of surface of an I-S hydroentangled spunbonded fabric with fibers completely fibrillated.

FIG. 14 shows SEM Micrographs of cross-section of an I-S spunbonded fabric before fibrillating.

FIG. 15 shows SEM Micrographs of hydroentangled point bonded spunbonded fabric.

FIG. 16 shows SEM Micrographs of a spunbonded fabric of fibrillated fibers subjected to two hydroentangling processes.

FIG. 17 shows various depictions of a tri-lobal bi-component fiber and a SEM Micrograph showing the core wrapped tips.

DETAILED DESCRIPTION

Figure 1:
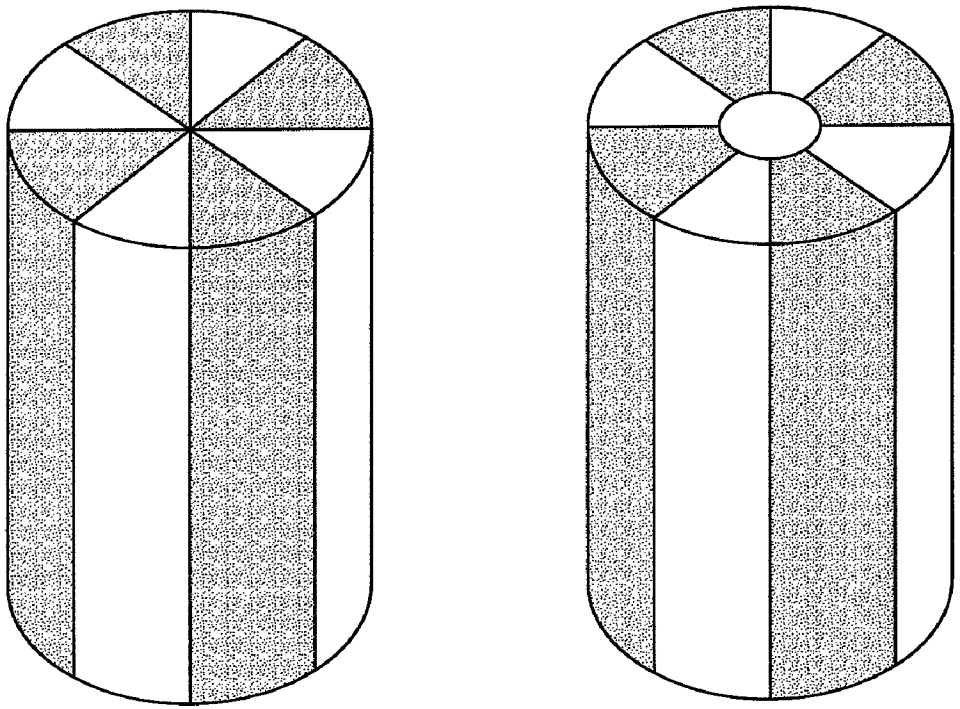
FIG. 1 is schematic drawing of typical bicomponent segmented pie fiber, solid (left) and hollow (right)
Figure 2:
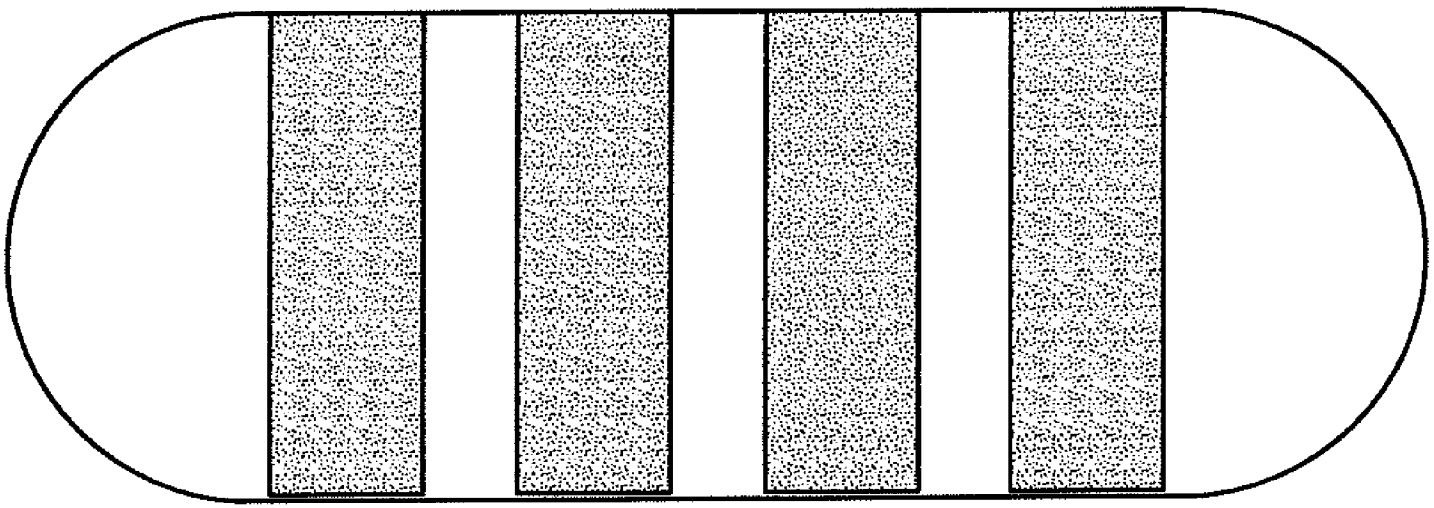
FIG. 2 is schematic of a typical segmented ribbon fiber.
Figure 4:
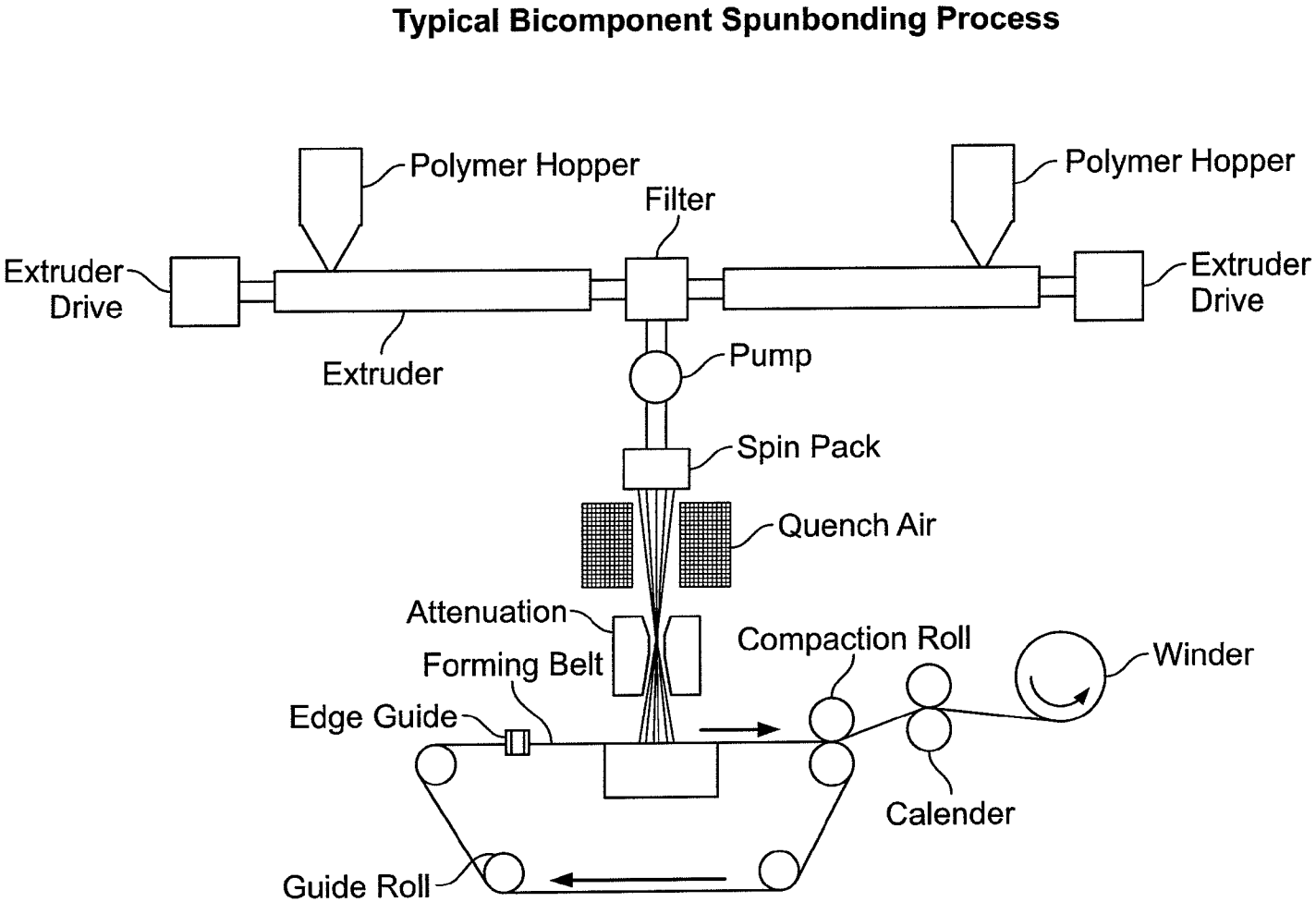
FIG. 4 depicts a typical bicomponent spunbonding process.
Figure 5:
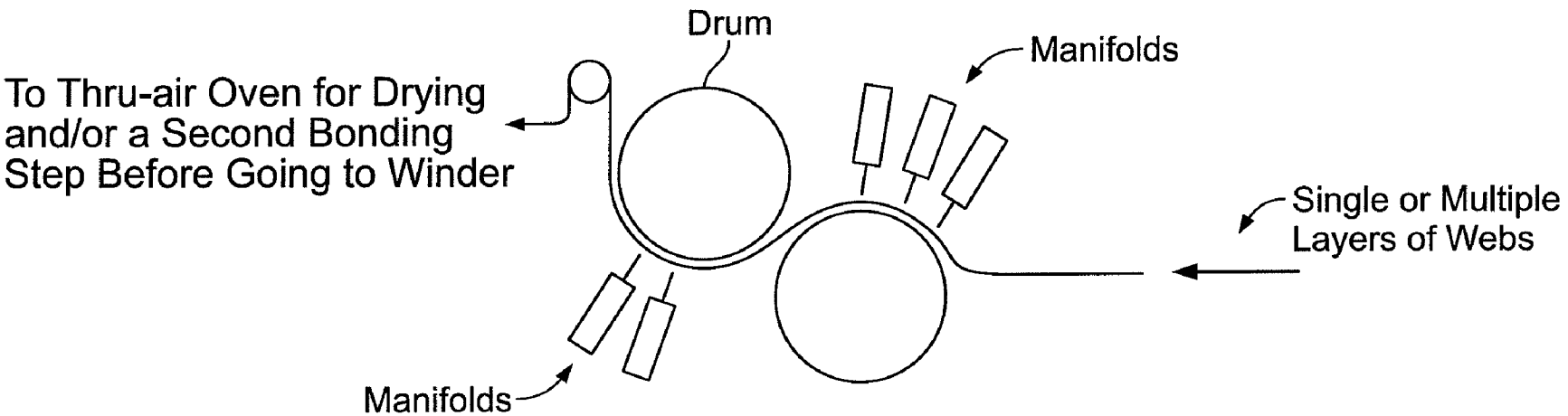
FIG. 5 shows the typical process for hydroentangling using drum entangler.

Referring now in more detail to the drawings, the invention will now be described in more detail. The subject matter disclosed herein relates to a method for producing continuous filaments and subsequent fabrics with improved flexibility, abrasion resistance and durability. The basis for the invention is the formation of a bicomponent filament which includes an external fiber component which envelopes an internal fiber component. Preferably, the internal fiber component consists of a plurality of fibers and the filament is of an island in the sea configuration. One important feature of the invention is that the external fiber enwraps the internal fiber. By doing so, the internal fiber is allowed to crystallize and solidify prior to the external fiber solidifying. This promotes an unusually strong island fiber. Such configuration enables the external fiber component to be fibrillated by external energy thereby separating itself from the internal fiber component. Another important aspect of the invention is that with the fibrillation, the internal sea fibers remain as continuous fibers and the external sea component also forms continuous fiber elements which interact with the sea fibers forming bonds between the respective fibers. This promotes the high strength aspect of the invention even though the respective fibers themselves are at the micro and nano levels.

Preferably, the external energy is provided by water jets in a hydroentanglement process which simultaneously fibrillates the external fibers and maintains the external fibers in a bonding configuration with other external fibers and also with the internal fibers. When this aspect of the invention is practiced, neither the internal island fibers or external sea fibers are soluble in water resulting in the external sea fibers to remain bonded with the internal sea fibers in the nonwoven article.

Preferably, the method for producing a nonwoven fabric includes spinning a set of bicomponent fibers which includes an external fiber component and an internal fiber component wherein the external fiber completely enwraps the internal fiber along its length. The external fiber in the most preferred embodiment is of softer material than the internal fiber and fibrillated exposing the internal fiber component. The fibers are continuous promoting the economical feasibility of the invention. Accordingly, when fibrillated, both the internal island fibers and external sea fibers are predominately continuous fibers intertwined with one another forming the high strength. Most preferably the fibrillation process utilizes hydro energy for fibrillating the external fiber component and is of sufficient energy for hydroentangling the set of bicomponent fibers. The hydroentanglement process typically occurs after the bicomponent fibers have been positioned onto a web. The process results in micro-denier fibers being produced which may be less than 0.5 microns.

Additionally, by providing an island in the sea configuration or a sheath/core configuration which is a sea of 1, different materials may be utilized for the sea component than is normally available utilizing segmented pie technology. Any two polymers that differ significantly in their melt temperature, viscosity and quenching characteristics cannot be formed into a splittable segmented pie fiber. Examples include polyolefins (PE, PP) and polyesters or nylons, polyolefins (PE, PP) and thermoplastic urethanes, polyesters or nylons and thermoplastic urethanes, etc. Any one of these combinations are possible in an islands in the sea fiber configurations because the sea wraps the islands and so long as the sea material can be extended or drawn during the fiber formation process, fiber formation will not be a challenge. Also, normally for island in the sea configurations, the sea is removed, consequently using inert materials for external components was previously impossible because they were hard to remove from solvents. By maintaining the external components, removal is not necessary and a stronger fiber is maintained due to the utilization of the external components in mechanical bonding of the fibers.

Another key aspect of the invention is that the internal component fiber may be produced having a non-wedge shape cross-section. Such cross-section may be multi-lobal or round. Such configurations provide for more bulk in the fabric and enable the fibers to have more movement than wedge shaped fibers. Such configuration produces a fiber which is harder to tear.

Furthermore, by fibrillating the eternal polymer component or the sea, a highly flexible and more breathable nonwoven fabric composed of micro or nano fibers may be produced which produces filters, wipes, cleaning cloths, and textiles which are durable and have good abrasion resistance. If more strength is required, the internal and external fibers may be subjected to thermal bonding after said external fibers have been fibrillated. In the bicomponent configuration, the external component may comprise about 5%-95% of the total fiber.

In selecting the materials for the fiber components, various types maybe utilized as long as the external fiber component is incompatible with the island component. Incompatibility is defined herein as the two fiber components forming clear interfaces between the two such that one does not diffuse into the other. One of the better examples include the utilization of nylon and polyester for the two various components. Wherein such fibers may be limited in their utilization in the typical prior art segmented pie structure, by utilizing the island in the sea structure the two components may co-exist forming a highly desireable high strength nonwoven. The internal fibers may comprise of thermoplastics selected from the group of thermoplastic polymers wherein the thermoplastic polymer is a copolyetherester elastomer with long chain ether ester units and short chain ester units joined head to tail through ester linkages. The internal fibers may comprise of polymers selected from the group of thermoplastic polymers wherein the thermoplastic polymer is selected from nylon 6, nylon 6/6, nylon 6,6/6, nylon 6/10, nylon 6/11, nylon 6/12 polypropylene or polyethylene, polyesters, co-polyesters or other similar thermoplastic polymers. The internal fibers may comprise of polymers selected from the group of thermoplastic polymers consisting of: polyesters, polyamides, thermoplastic copolyetherester elastomers, polyolefines, polyacrylates, and thermoplastic liquid crystalline polymers.

The external fibers may also comprise thermoplastics selected from the group of thermoplastic polymers wherein said thermoplastic polymer is a copolyetherester elastomer with long chain ether ester units and short chain ester units joined head to tail through ester linkages. The external fibers may comprise polymers selected from the group of thermoplastic polymers wherein the thermoplastic polymer is selected from nylon 6, nylon 6/6, nylon 6,6/6, nylon 6/10, nylon 6/11, nylon 6/12 polypropylene or polyethylene. The external fibers are comprised of polymers selected from the group of thermoplastic polymers consisting of: polyesters, polyamides, thermoplastic copolyetherester elastomers, polyolefines, polyacrylates, and thermoplastic liquid crystalline polymers.

During the processing, the fibers are drawn at a ratio preferably four to one. Also, the fibers are spun vary rapidly and in some examples at three and four thousand meters per minute. With the internal fiber completely enwrapped, the fiber solidifies quicker than the external fiber. Additionally, with the clear interface between the two and low or no diffusion between the internal and external fibers, the fibers are readily fibrillated. The fibrillation may be conducted mechanically, via heat, or via hydroentangling. If hydroentangling is utilized, the fabric having external surfaces exposed may have two external surfaces or only one external surface subjected to the hydroentanglement processing. Preferably, water pressure from one or more hydroentangling manifolds is utilized for fibrillating and hydroentangling the fiber components at a water pressure between 10 bars to 1000 bars. Another feature of the invention is that the fiber materials selected are receptive to coating with a resin to form an impermeable material or may be subjected to a jet dye process after the external component is fibrillated. Preferably, the fabric is stretched in the machine direction during a drying process for re-orientation of the fibers within the fabric and during the drying process, the temperature of the drying process is high enough above the glass transition of the polymers and below the onset of melting to create a memory by heat-setting so as to develop cross-wise stretch and recovery in the final fabric.

The critical feature of the invention is that the sea fibers are intertwined and entangled with the island fibers upon fibrillation. Consequently, while the island fibers can be manufactured at the micro and nano levels, the sea component also separates between the respective fibers forming micro and nano fibers of the sea component. Thus, the sea and island fibers produce continuous micro and nano fibers from a single bicomponent fiber. Also, with the fibers maintaining their structural integrity, they are enabled to intertwine and entangle amongst themselves forming the high strength fiber. Additionally, but being able to utilize incompatible components, the ultimate non-woven article may be produced utilized such components which are not feasible to combine utilizing prior art segmented pie technology.

Additionally, while certain prior art discloses island in the sea fiber configurations, such disclosures typically disclose the utilization of PVA. Since PVA is typically water soluble it is not conducive to hydroentangling and also not suitable for formation into articles which may be subjected to water environments.

While the invention contemplates the manufacturing of bicomponent fibers, the invention also relates to the manufacturing of continuous bicomponent filaments and the incorporation of the filaments into nonwoven articles of manufacture. This manufacturing may be conducted to produce fabrics which are woven or knitted and made from bicomponent islands in the sea fibers and filaments or can be nonwovens and formed by either spunbonding or through the use of bicomponent staple fibers formed into a web by any one of several means and boded similarly to those used for the spunbonded filament webs.

Figure 6:
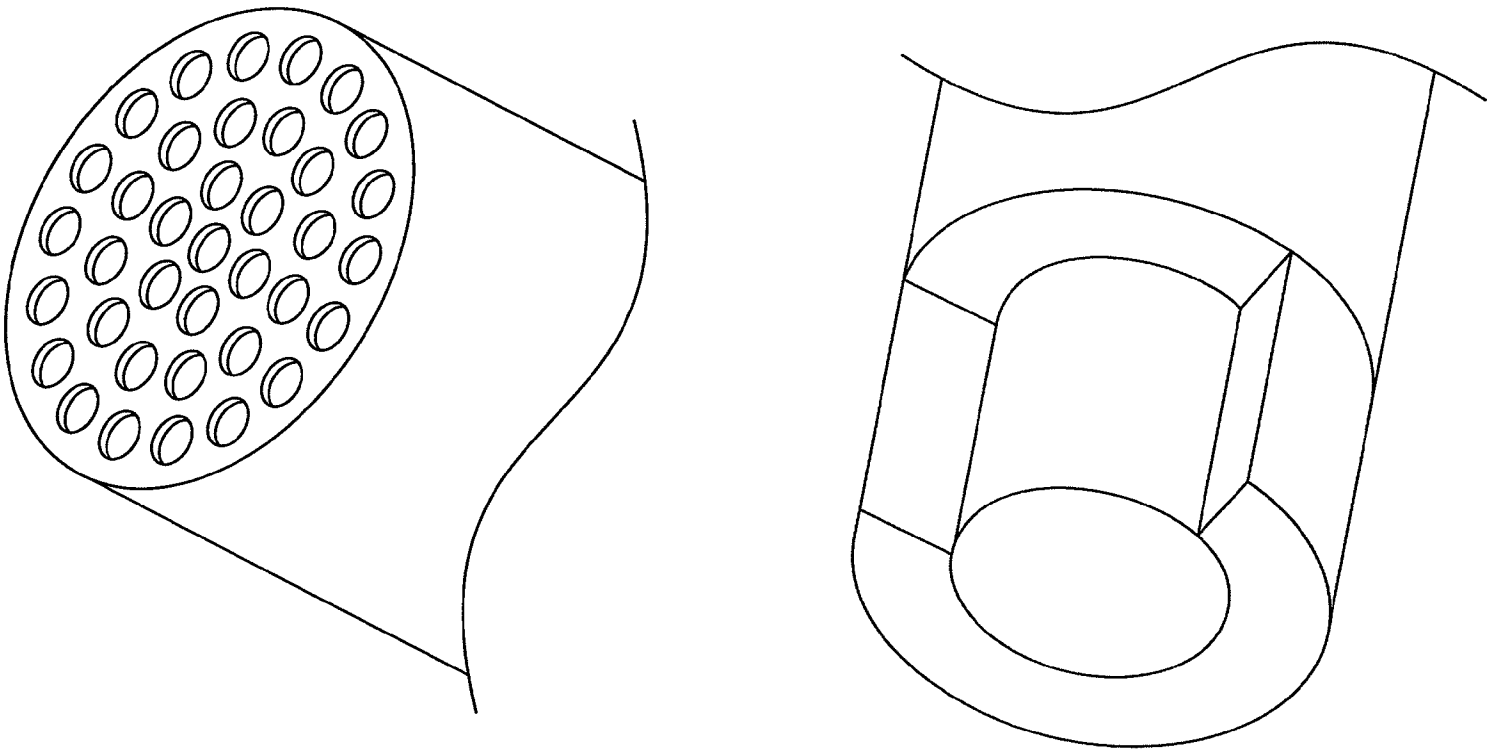
FIG. 6 shows the bicomponent fibers employed—islands-in the sea (left) and sheath-core (right)
Figure 8:
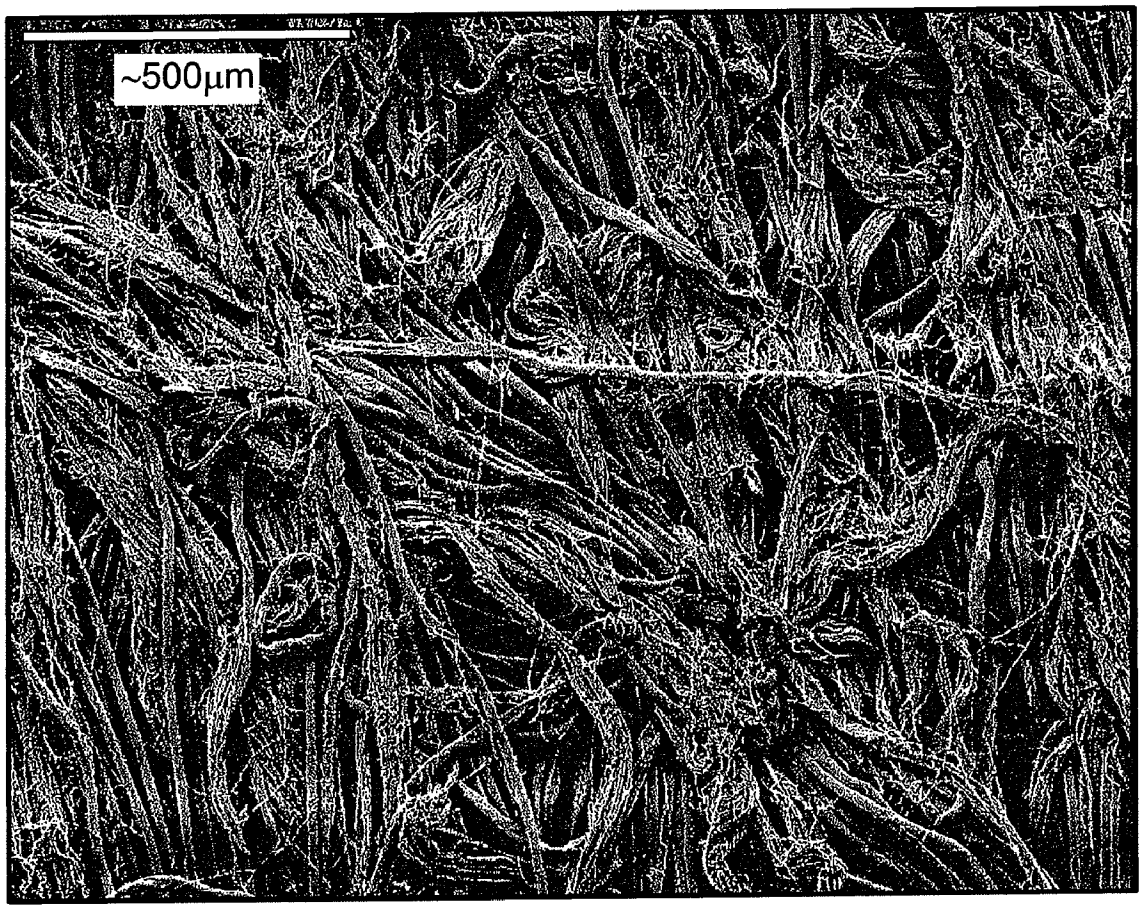
FIG. 8 shows SEM Micrographs of surface of an I-S hydroentangled spunbonded fabric with fibers partially fibrillated.
Figure 9:
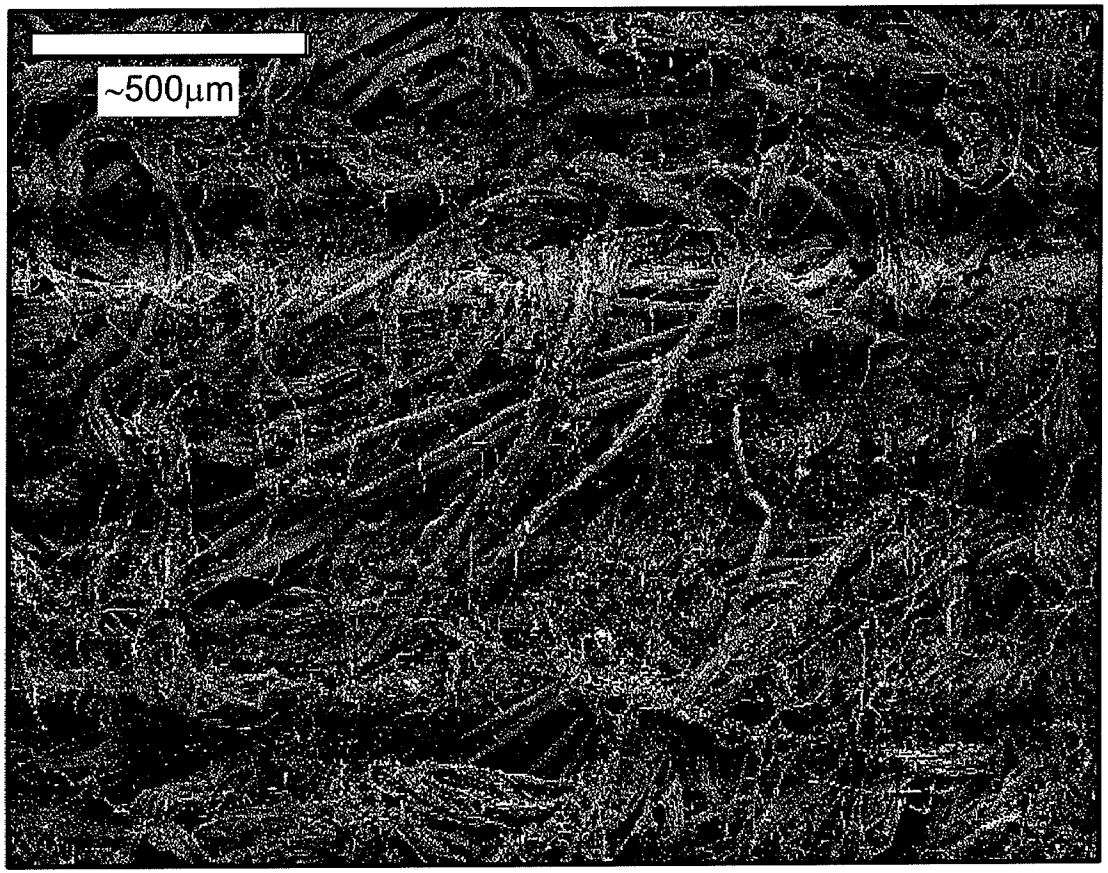
FIG. 9 shows SEM Micrographs of surface of an I-S hydroentangled spunbonded fabric with fibers completely fibrillated.
Figure 10:
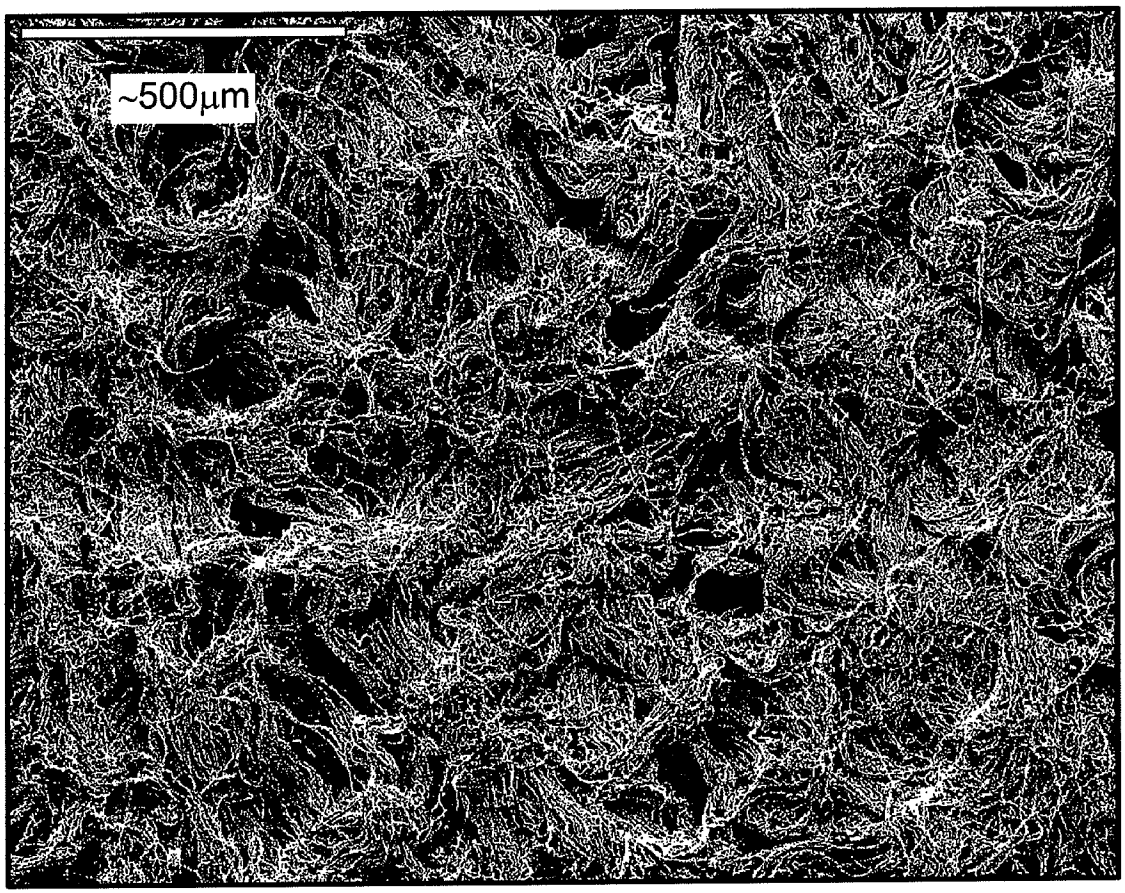
FIG. 10 shows SEM Micrographs of surface of an I-S hydroentangled spunbonded fabric with fibers completely fibrillated.

The inventors have discovered that is a bicomponent fiber in the form of sheath-core or islands-in-the-sea is employed (FIG. 6), the fiber can be made to split by hydroentangling if the sheath or the sea polymer is sufficiently weak and particularly when the two components have little or no affinity for one another. Examples of the fibers are shown in FIG. 7. Note that the islands are "protected" by the sea (or the sheath) and therefore, fiber spinning will not be as challenging. The use of a polymer that can be easily mechanically split or fibrillated is advantageous. The fibers in FIG. 7 are all made from a linear low density polyethylene (LLDPE) and the core or the islands are made from nylon. These polymer combinations appear to work well when there is a need to split the fibers mechanically. Other combinations such as nylon and polyester and PLA with other polymers such as nylon, thermoplastic urethanes and other thermoplastics are also possible. The final structure will be quite flexile and soft and compressible. The amount of energy transferred to the fabric determines the extent to which the fibers split. FIGS. 8 and 9 show the surface of a 200 gsm fabric hydroentangled at low and high energy levels respectively. It is clear that the lower energy levels were not adequate in splitting the fibers completely.

In some preferred embodiments, the fabric consisting of fibrillated fibers is point bonded for further strength.

Examples of the strength of the fibers produced are reflected below:

EXAMPLES

Several examples are given below demonstrating the properties of the fabrics produced.

All fabrics weighed about 180 g/m$^2$.

Example 1

100% Nylon Hydroentangled Samples at Two Energy Levels

| 100% Nylon - Tongue Tear [lb] | | | | | | |
|---|---|---|---|---|---|---|
| Bonding | Specific Energy [kJ/kg] | Calender Temperature [C.] | MD Mean | Standard Error | CD Mean | Standard Error |
| Hydroentangled Only | 6568.72 | 0 | 16.00 | 1.31 | 15.73 | 2.22 |
| Hydroentangled and Calendered | 6568.72 | 200 | 9.00 | 0.69 | 14.46 | 0.63 |

| 100% Nylon - Grab Tensile [lb] | | | | | | |
|---|---|---|---|---|---|---|
| | Specific Energy [kJ/kg] | Calender Temperature [C.] | MD Mean | Standard Error | CD Mean | Standard Error |
| Hydroentangled Only | 6568.72 | 0 | 170.34 | 5.17 | 92.58 | 5.35 |
| Hydroentangled and Calendered | 6568.72 | 200 | 157.60 | 6.84 | 81.37 | 6.40 |

Example 2

75/25% Nylon Islands/PE Sea, 108 Islands

| 75/25% Nylon/PE, 108 islands - Tongue Tear [lb] | | | | | | |
|---|---|---|---|---|---|---|
| | Specific | Calender | MD | | CD | |
| Bonding | Energy [kJ/kg] | Temperature [C.] | Mean | Standard Error | Mean | Standard Error |
| Hydroentangled Only | 6568.72 | 0 | 16.00 | 1.31 | 15.73 | 2.22 |
| Hydroentangled and | 6568.72 | 145 | 38.16 | 2.98 | 28.45 | 0.58 |

-continued

| Calendered | | | | | | |
|---|---|---|---|---|---|---|
| 75/25% Nylon/PE, 108 islands - Grab Tensile [lb] | | | | | | |
| | Specific | Calender | MD | | CD | |
| | Energy [kJ/kg] | Temperature [C.] | Mean | Standard Error | Mean | Standard Error |
| Hydroentangled Only | 6568.72 | 0 | 59.32 | 1.83 | 96.94 | 2.35 |
| Hydroentangled and Calendered | 6568.72 | 145 | 231.15 | 8.70 | 128.15 | 17.29 |

Note that calendaring improves the properties because the sea is melted and wraps the fibers adding to the strength.

Note that all islands-in-sea samples are significantly superior to the 100% nylon.

Articles which may be manufactured utilizing the high strength bicomponent nonwoven fabric include tents, parachutes, outdoor fabrics, house wrap, awning, and the like. Some examples have produced nonwoven articles having a tear strength greater than 6 grams per denier and others enduring over ten pounds of tearing forces.

The inventors have discovered that, if properly done, islands in the sea provides a very flexible method for forming fibrillated fibers wherein the island fiber size can be controlled by the total number of island count all else being equal. This has been reduced to practice and specifically the spunbonding technology offer a simple and cost effective method for developing such durable fabrics.

Figure 18:
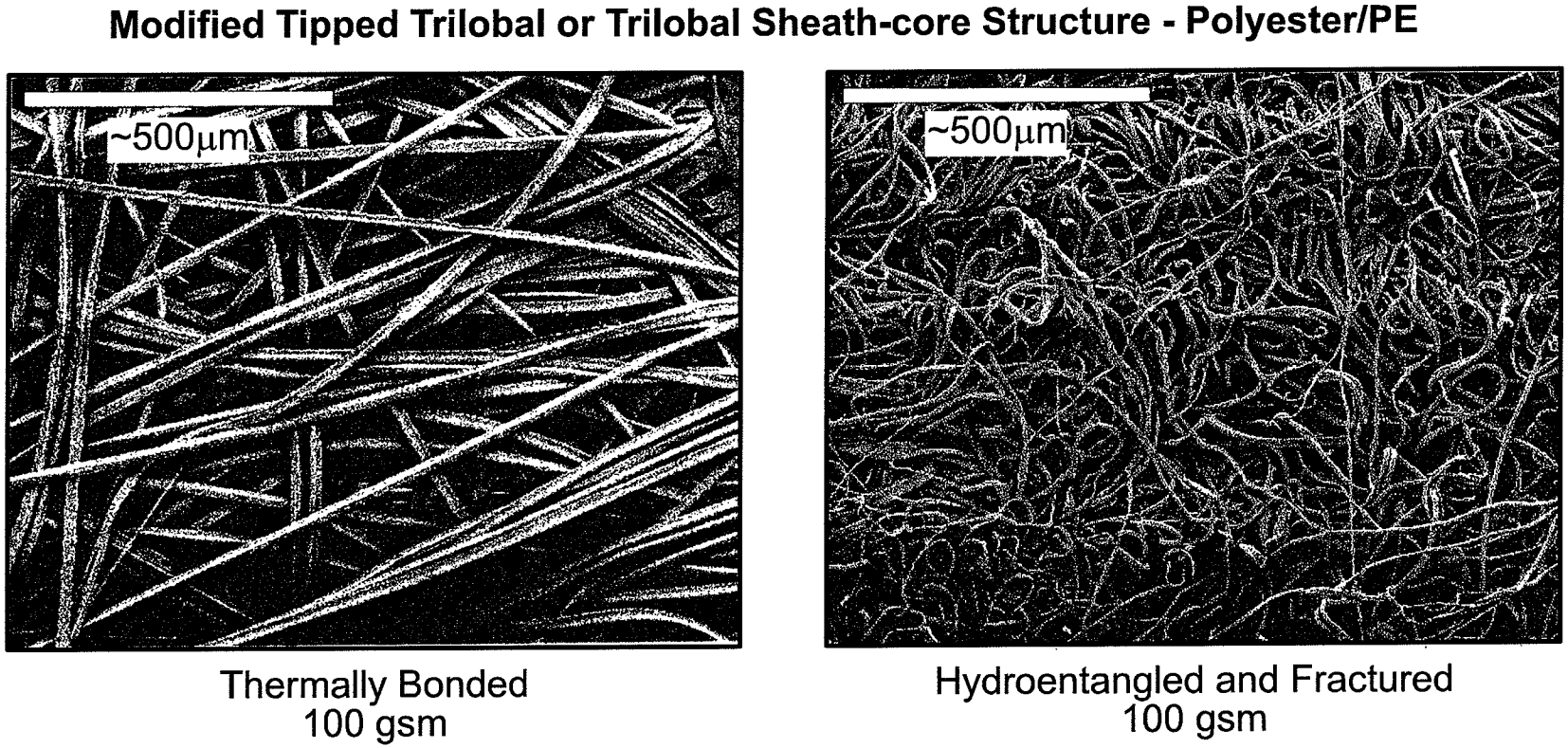
FIG. 18 illustrates tri-lobal bicomponent fibers thermally bonded and fibrillated and bonded.
Figure 19:
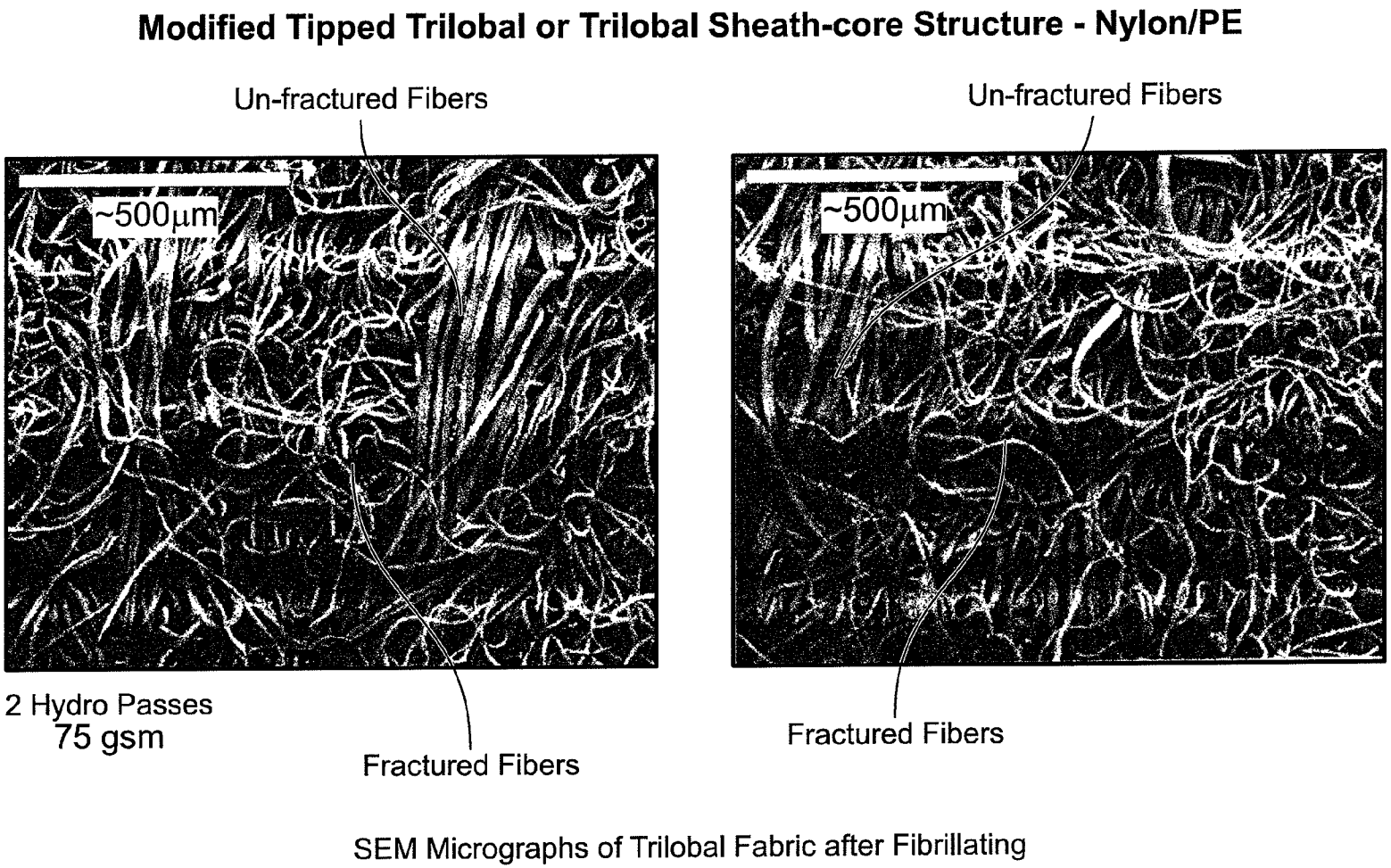
FIG. 19 illustrates a tri-lobal bicomponent fiber which has been fibrillated with insufficient energy.

Also, as shown in FIGS. 17, 18 and 19, the bicomponent fiber may be tri-lobal. In this configuration the central island is completely encircles by three lobes. Consequently, when fibrillated, four separate fibers are produced which enwrap upon each other forming a high strength fabric. Such a structure may be more feasible in some situations where a complete island in the sea structure cannot be manufactured. Also, the differences between thermally bonded bicomponent fibers and fibrillated and bonded bicomponent fibers are illustrated. Also FIG. 19 illustrates when insufficient energy is utilized when fibrillating the fibers.

The invention relates to a method for producing a high strength spunbonded nonwovens with improved flexibility, abrasion resistance and durability which has been disclosed. The basis for the invention is the formation of a bicomponent spunbonded web composed of two polymers different in their chemical structure in the form of a sheath-core (one island) or islands in the sea wherein the sea material protects the sheath or the islands and is a softer material than the island or the core, and where such web is bonded by:

(a) Needle punching followed by hydroentangling without any thermal bonding wherein the hydroentangling energy result in partial or complete splitting of the sheath core or the islands in the sea structure.

(b) hydroentangling the web alone without any needle punching or subsequent thermal bonding wherein the hydroentangling energy result in partial or complete splitting of the sheath core or the islands in the sea structure.

(c) hydroentangling the web as described in (a) above followed by thermal bonding in a calender.

(d) hydroentangling the web as described in (a) above followed by thermal bonding in a thru-air oven at a temperature at or above the melting temperature of the melting sea or sheath to form a stronger fabric.

What is claimed is:

1. A method of producing a nonwoven fabric in the form of a web suitable for use in forming a nonwoven article, comprising:

spinning a set of bicomponent fibers comprising an external fiber component and an internal fiber component, wherein said external fiber component enwraps said internal fiber component and the cross-section of the internal fiber component is round or multi-lobal, and wherein both the external fiber component and the internal fiber component are insoluble in water, said spinning being carried out such that the internal fiber component crystallizes and solidifies prior to the external fiber component solidifying;

positioning said set of bicomponent fibers onto a web;

fibrillating the bicomponent fibers positioned on the web, the fibrillating step causing the external fiber component to separate from and expose the internal fiber component such that the internal fiber component, after fibrillation, is in the from of entangled micro-denier fibers and the external fiber component is provided as micro-denier fiber elements that are intertwined with the micro-denier fibers; and collecting the web of entangled, internal component fibers and intertwined, external component fiber elements, such external component fiber elements enhancing the strength of the web.

2. The method of claim 1 wherein the fibrillating step comprises utilizing hydro energy.

3. The method of claim 2 wherein the fibrillating step comprises hydroentangling the set of bicomponent fibers.

4. The method of claim 1 wherein said internal and external fiber components are subjected to thermal bonding after said bicomponent fibers have been fibrillated.

5. The method of claim 1 wherein said external fiber component is more viscous than said internal fiber component of said bicomponent fiber.

6. The method of claim 1 wherein said internal fiber components comprise a copolyetherester elastomer with long chain ether ester units and short chain ester units joined head to tail through ester linkages.

7. The method of claim 1 wherein said external fiber components comprise a copolyetherester elastomer with long chain ether ester units and short chain ester units joined head to tail through ester linkages.

8. The method of claim 1 wherein said internal fiber components comprise a polymer selected from the group consisting of nylon 6, nylon 6/6, nylon 6,6/6, nylon 6/10, nylon 6/11, nylon 6/12, polypropylene, and polyethylene.

9. The method of claim 1 wherein said external fiber components comprise a polymer selected from the group consisting of nylon 6, nylon 6/6, nylon 6,6/6, nylon 6/10, nylon 6/11, nylon 6/12, polypropylene, and polyethylene.

10. The method of claim 1 wherein said external fiber components comprise a polymer selected from the group consisting of polyesters, polyamides, thermoplastic copolyetherester elastomers, polyolefins, polyacrylates, and thermoplastic liquid crystalline polymers.

11. The method of claim 1 wherein said internal fiber components comprise a polymer selected from the group consisting of polyesters, polyamides, thermoplastic copolyetherester elastomers, polyolefins, polyacrylates, and thermoplastic liquid crystalline polymers.

12. The method of claim 1 wherein said internal fiber component is multi-lobal.

13. The method of claim 1 wherein said internal fiber component has a round cross-section.

14. The method of claim 1 wherein said external fiber component comprises about 5%-95% of the total fiber.

15. The method of claim 1 wherein the web of bicomponent fibers has two external surfaces and the web is exposed to hydroentanglement at both surfaces.

16. The method of claim 1 wherein only one surface of the web of bicomponent fibers is exposed to hydroentanglement processing.

17. The method of claim 1 wherein the web of bicomponent fibers is exposed to water pressure from one or more hydroentangling manifolds at a water pressure between 10 bars to 1000 bars.

18. The method of claim 1 wherein the web of bicomponent fibers is coated with a resin to form an impermeable material.

19. The method of claim 1 wherein the web of bicomponent fibers is subject to a jet dye process after said bicomponent fibers are fibrillated.

20. The method of claim 1 wherein the fibrillating step comprises hydroentangling and the method further comprising drying the web of bicomponent fibers after hydroentangling, wherein the web is stretched in the machine direction during the drying process for re-orientation of the fibers within the web.

21. The method of claim 20 wherein the temperature of the drying process is high enough above the glass transition of the polymers and below the onset of melting to create a memory by heat-setting so as to develop cross-wise stretch and recovery in the web.

22. The method of claim 1, wherein said external fiber component is made of softer material than said internal fiber component.

23. The method of claim 22 wherein said internal fiber components includes a plurality of internal fiber components which have different mechanical properties selected from the group comprising elasticity, wetness, flame retardation, elongation to break, and hardness.

24. The method of claim 22 wherein said internal fiber components includes a plurality of internal fiber components having different cross-sections.

25. The method of claim 1 wherein the bicomponent fibers are formed from substantially continuous thermoplastic filaments.

26. The method of claim 1 wherein the bicomponent fibers are staple fibers.

27. The method of claim 1 wherein the bicomponent fibers are in the form of sheath/core fibers.

28. The method of claim 1 wherein the bicomponent fibers are in the form of islands-in-the-sea fibers.

29. The method of claim 1 wherein the internal fiber component comprises a polyester or a nylon and the external fiber component comprises a polyolefin.

30. The method of claim 1 further comprising forming an article from the nonwoven fabric.

31. A method of producing a nonwoven fabric in the form of a web suitable for use in forming a nonwoven article, comprising:

spinning a set of continuous filament bicomponent islands-in-the-sea fibers comprising a plurality of internal islands enwrapped by an external sea component, wherein the cross-section of the internal islands is round or multi-lobal, and wherein both the external sea component and the internal islands are insoluble in water, said spinning being carried out such that the internal islands crystallize and solidify prior to the external sea component solidifying;

positioning said set of bicomponent islands-in-the-sea fibers onto a web;

hydroentangling the continuous filament bicomponent islands-in-the-sea fibers to form a web, the hydroentangling causing the external sea component to separate and expose the internal islands such that the internal islands, after hydroentangling, are in the form of entangled micro-denier fibers and the external sea component is provided as micro-denier fiber elements that are intertwined with the micro-denier internal island fibers; and collecting the web of entangled, internal island fibers and intertwined, external sea component fiber elements, such external sea component fiber elements enhancing the strength of the web.

32. The method of claim 31 wherein said web is subjected to thermal bonding after said hydroentangling step.

33. The method of claim 31 wherein said external sea component is more viscous than said internal islands of said bicomponent fiber.

34. The method of claim 31 wherein the internal islands comprises a polyester or a nylon and the external sea component comprises a polyolefin.

35. The method of claim 31 wherein one of the internal islands and the external sea component comprises a polyester and the other of the internal islands and the external sea component comprises a nylon.

36. The method of claim 31 further comprising forming an article from the nonwoven fabric.

* * * * *